United States Patent [19]

Olofsson

[11] Patent Number: 4,863,357

[45] Date of Patent: Sep. 5, 1989

[54] ROTARY POSITIVE DISPLACEMENT MACHINE FOR A COMPRESSIBLE WORKING FLUID

[75] Inventor: Hans Olofsson, Huddinge, Sweden

[73] Assignee: Svenska Rotor Maskiner AB, Stockholm, Sweden

[21] Appl. No.: 249,570

[22] PCT Filed: Apr. 21, 1987

[86] PCT No.: PCT/SE87/00203

§ 371 Date: Sep. 14, 1988

§ 102(e) Date: Sep. 14, 1988

[87] PCT Pub. No.: WO87/06654

PCT Pub. Date: Nov. 5, 1987

[30] Foreign Application Priority Data

Apr. 23, 1986 [GB] United Kingdom ..... 8609870
Jun. 17, 1986 [SE] Sweden ..... 8602683

[51] Int. Cl.[4] ..... F04B 17/02; F04C 15/02
[52] U.S. Cl. ..... 417/356; 418/48
[58] Field of Search ..... 417/356; 418/48

[56] References Cited

U.S. PATENT DOCUMENTS 2,085,115 6/1937 Moineau .
2,615,436 10/1952 Pawl ..... 418/48 X
2,711,286 6/1955 McAdam ..... 417/356
2,733,854 2/1956 Chang .
2,765,114 10/1956 Chang .
2,871,793 2/1959 Michie et al. ..... 417/356
3,479,960 11/1969 Cardoso ..... 418/48 X
4,802,827 2/1989 Fujiwara et al. ..... 417/356

FOREIGN PATENT DOCUMENTS 0083830 6/1954 Norway ..... 418/48
0400689 11/1970 U.S.S.R. ..... 418/48
0375408 6/1973 U.S.S.R. ..... 418/48
0412367 9/1974 U.S.S.R. ..... 418/48

*Primary Examiner*—Carlton R. Croyle
*Assistant Examiner*—Eugene L. Szczecina, Jr.
*Attorney, Agent, or Firm*—Frishauf, Holtz, Goodman & Woodward

[57] ABSTRACT

Rotary positive displacement machine for a compressible working fluid comprising two tapered, internally intermeshing members (26, 28) with eccentric axes (48, 50). The members (26, 28) have spiral grooves (34, 38) and intervening lands (36, 40) which cooperate to form closed chambers (66) varying in volume while moving axially from one end to the other. The inner member (28) has a hypocyclic movement in relation to the outer member (26). The radial depth of the grooves (34, 38) varies axially along the members (26, 28) and in each transverse plane is equal to twice the eccentricity of the axes (48, 50) of the members (26, 28) and the pitch angle of the spiral at the pitch cone varies continuously in the axial direction.

10 Claims, 3 Drawing Sheets

ROTARY POSITIVE DISPLACEMENT MACHINE FOR A COMPRESSIBLE WORKING FLUID

BACKGROUND OF THE INVENTION

The present invention concerns a rotary positive displacement machine for a compressible working fluid with intermesh between two cooperating members. The machine is primarily intended for use as a compressor or a vacuum pump but may also be used as an expander or a metering device.

Up to now such machines have generally been of two different types.

The first of those types is the screw rotor machine comprising two externally intermeshing rotors of different profiles enclosed in a casing and rotatable in opposite directions around spaced parallel axes. An example of such a machine is shown in U.S. Pat. No. 3,423,017. In this type of machine one groove in each rotor communicate with each other and form a closed chevron-shaped chamber covered by confronting portions of the barrel wall and of the high pressure end wall. The volume of this closed chamber varies as the rotors rotate. As the rotor land tips normally do not meet on the intersection line between the two barrel sections of the casing a blow hole is formed which means a leakage opening from the chamber to the consecutive chevron-shaped chamber. Furthermore there is always a certain clearance between the end surfaces of the rotors and the high pressure end wall of the casing which results in a certain leakage from the high pressure phase of the machine directly to its low pressure phase, as a portion of the high pressure end wall always cooperates with rotor grooves communicating with the low pressure channel of the machine.

The second of those types is the so called Scroll compressor comprising two members each having a spiral element extending axially from a flat disk. Examples of such a machine are shown in U.S. Pat. Nos. 4,259,043 and 4,395,205. A first member of the machine is held stationary whereas the second member is kept against rotation while its centre is orbiting around the centre of the first member. The spiral elements are dimensioned such that they cooperate alternatingly on one side and the other thereof to form closed pockets therebetween. Those pockets are further sealed off from each other by axially movable sealing strips provided in grooves in the tops of the spiral elements for cooperation with the flat surface of the other disk which unavoidably results in certain leakage openings along the sealing strips partly between the ungrooved top and the disk, partly between the strip and the walls of the groove. The machine further requires means for accurate guiding of the second movable member, thrust bearings to keep the clearance between the members on a small positive value, and means for transforming the rotation of the driving shaft into an oscillating movement of the movable member.

It has further been suggested, as disclosed in U.S. Pat. No. 2,733,854, to make a compressor composed of two sealingly cooperating conical members with coinciding apices intermeshing internally by a hypocyclic motion around the common apex point with a speed ratio of 2 to 1. The machine patented and disclosed is restricted to a type where at least the inner member, shaped as a rod twisted into a conical coil, is manufactured by casting and dimensioned such that it will keep its shape independent of any shrinkage. This means that all dimensions thereof must be direct proportional to the distance from its apex. The axial lead of the coil is consequently proportional to the distance from the apex, whereas the ptich angle is constant. However, this design unavoidably results in a fundamental disadvantage due to the fact that dependent upon the varying axial lead it is impossible to insert the inner member into the outer member without deformation of at least one of the members. For this reason the outer member in the suggested machine is and has to be manufactured from a resilient material. This fact means that when the machine is in function and the pressure inside thereof increases a certain deformation of the resilient member is unavoidable resulting on one side in an increased leakage between the two members, and on the other side in an increased contact pressure between the two members in position opposite to the maximum deformation resulting in increased friction therebetween. In other words the volumetric efficiency of the machine decreases simultaneously as the mechanical losses therein increases resulting in a spoiling of the overall efficiency to such a degree that the machine cannot be used in practice.

A similar type of machine is shown in DE-OS No. 2 736 590. This machine, intended for use as a pump for high-viscous liquids, is still more specialized in that the inner member is shaped as a conical coil wound from a circular rod with constant cross section where the centre of the circle in any axial plane is disposed on the pitch circle of the member. However, also this machine is provided with an outer member manufactured from resilient material and consequently has the same disadvantages as those of the machine disclosed in U.S. Pat. No. 2,733,854.

SUMMARY OF THE INVENTION

The present invention relates to a machine of a type similar to that disclosed in U.S. Pat. No. 2,733,854, combining advantageous characteristics of the conventional screw rotor machine with external intermesh and the Scroll compressor, simultaneously as disadvantageous characteristics of the different types are eliminated.

The new machine of the present invention thus is a rotary positive displacement machine of hypocyclic bevel gearing type for a compressible working fluid, comprising an outer and an inner member provided with intermeshing spiral grooves and intervening lands where the number of grooves in the outer member is larger than that in the inner member with a difference therebetween of one and the wrap angle of each groove in the outer member exceeds 360°, said grooves and lands forming continuous sealing lines therebetween to define closed chambers between consecutive sealing lines, said members rolling on each other along pitch cones with coinciding apices, at least one of said members being rotatable around its axis and at least one being mounted for revolving oscillation around the apex point of the pitch cones, the circumscribing envelope of the inner member being shaped as a frustum of a cone, and the outer member being shaped as a socket having an inscribing envelope in the form of a frustum of a cone and provided with open ends forming low pressure and high pressure ports for communication with stationary low pressure and high pressure channels, respectively.

The object of the invention is to achieve a practicable machine for a compressible working fluid of the type specified above.

This has been achieved in that a machine of said type is so designed that the radial depth of the grooves varies axially along the members and in each transverse plane is equal to twice the eccentricity of the axes of the members and that the pitch angle of the spiral at the pitch cone varies continuously in the axial direction.

Due to the feature that said radial depth varies in the specified way optimal performance conditions for a machine of the type concerned working as a compressor or expander are attained and due to the continuously varying pitch angle a substantially constant axial distance between the lands is received, allowing a trouble-free assembly of the two members. Thanks to these particular features it has become possible to realize a machine of the new type combining the advantageous characteristics of the two types introductionally mentioned.

By the new machine of the present invention it is possible to completely eliminate the blow hole and the high pressure end leakage of the screw compressor as well as the sealing strips and the guiding means for the second member of the Scroll compressor simultaneously as the bearings may be much simpler than in that machine. Furthermore the new machine has the advantage of being very compact and of circular outer shape having a very small diameter which makes it very suitable for installation in a narrow space.

The invention will now be described more in detail in connection with the embodiment of a compressor which is shown in the accompanying drawings.

DETAILED DESCRIPTION

Figure 1:
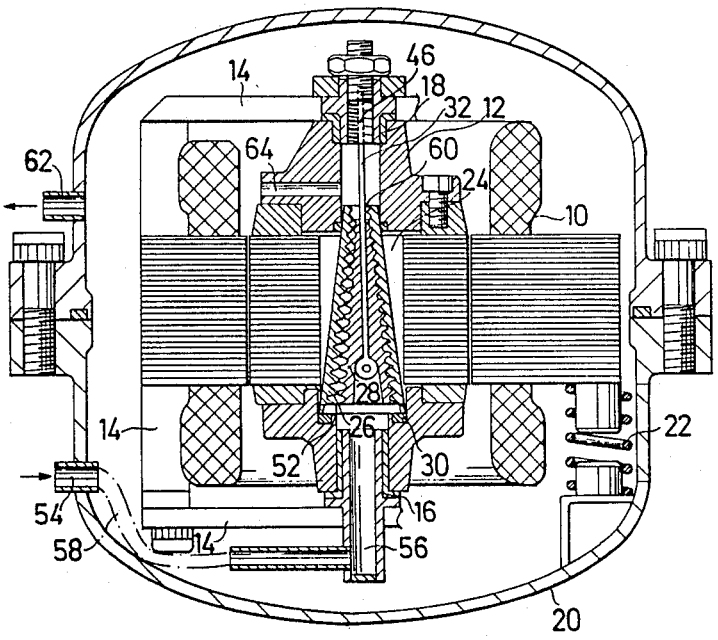
FIG. 1 shows a section through a hermetically closed refrigeration compression apparatus.
Figure 2:
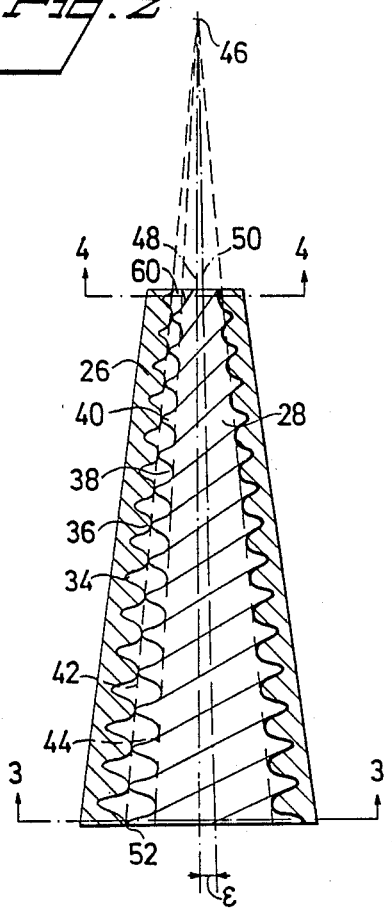
FIG. 2 shows a detail of FIG. 1 on a larger scale.
Figure 3:
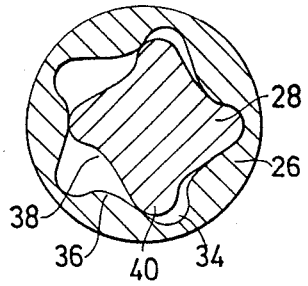
FIG. 3 shows a section of FIG. 2 taken along line 3—3.
Figure 4:
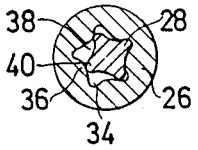
FIG. 4 shows another section of FIG. 2 taken along line 4—4.

The compression apparatus shown in FIG. 1 comprises an electric motor having a stator 10 and a rotor 12 rotatably mounted within the stator by a yoke 14 carrying the rotor bearings 16 and 18. The motor is enclosed by a hermetically sealed cover 20 and resiliently supported therein by means of a number of spring elements 22.

The rotor shaft is provided with an axial through hole 24. Within this hole a compressor comprising two internally cooperating members 26, 28 is mounted. The outer member 26 is shaped as a truncated conical socket which is coaxial with and axially, radially and non-rotatably fixed to the rotor 12. The big end of the conical socket 26 is further sealingly connected with the rotor 12 by means of a gasket 30. The inner member 28 of the compressor is shaped as a truncated cone axially and non-rotatably fixed to the stator 10 by means of a flexible rod 32 centrally fixed in the inner member 28.

As more specifically shown in FIGS. 2–5 the conical socket forming the outer member 26 is provided with five spirally extending grooves 34 and intervening lands 36 having continuously varying pitch angles in its inner surface. Due to the conical shape, the continuously varying pitch angles result in a constant axial pitch. The cone forming the inner member 28 is provided with four spirally extending grooves 38 and intervening lands 40 having continuously varying pitch angles in the outer surface thereof, said grooves 38 and lands 40 intermeshing with the lands 36 and grooves 34 of the outer member 26 and cooperating sealingly with the flanks thereof to form continuous sealing lines therebetween. In each axial plane the inner member 28 thus has a motion of hypocyclic type in relation to the outer member 26, i.e. in each plane the two members 26, 28 have pitch circles rolling on each other, which means that the two members 26, 28 have pitch cones 42, 44 rolling on each other. Those pitch cones have their apices located in a common point 46. The axis 48 of the pitch cone 42 of the outer member 26 and the axis 50 of the pitch cone 44 of the inner member 28 form a constant angle "$\epsilon$" therebetween. When the two pitch cones 42, 44 roll on each other the inner member 28 will thus move like a conical pendulum around the common point 46 with regard to the outer member 26.

The big end of the outer member 26 is open and forms a low pressure port 52 for communication with a stationary low pressure channel 54 extending out through the wall of the cover 20, via a pipe 56 extending axially through the rotor bearing 16 and via a resilient channel 58. The small end of the outer member is also open and forms a high pressure port 60 communicating with a stationary high pressure channel 62 extending out through the wall of the cover 20, via a radial passage 64 from the hole 24 in the rotor 12 and via the free space inside the cover 20.

As shown in FIGS. 5A–5F the compressor 26, 28 acts in the following way. When the outer member 26 is rotated around its centre 48 by the rotor 12 it intermeshes with the non-rotatable inner member 28. The centre 50 of inner member 28 will then orbit in a circular path around the centre 48 of the outer member 26 in the same direction and with an angular speed that is five times that of the outer member 26, i.e. the speed ratio is the same as the number of grooves 34 in the outer member 26.

In FIG. 5A a land 40' of the inner member 28 is in full intermesh with a groove 34' of the outer member, which means that the centre 50 of the inner member 28 lies on a radius drawn from the centre 48 of the outer member 26 through the meshing point between the bottom of the groove 34' and the top of the land 40'. When the outer member 26 rotates from this position the centre 50 of the inner member is forced to move in the same direction around the centre 48 of the outer member and a chamber 66 comprising a portion of the groove 34' in the outer member 26 and a portion of the groove 38 located between the lands 40' and 40'' of the inner member 28 is opened towards the inlet port 52 simultaneously as the intermesh between the groove 34' and the land 40' moves axially into the two members 26 and 28. In this way a certain volume of low pressure working fluid is sucked in into the chamber 66.

In FIG. 5B the angle of rotation from the starting position defined with regard to FIG. 5A has reached the value "$\alpha$" whereas the centre 50 of the inner member 28 simultaneously has orbited an angle "$\beta$" of 90° around the centre 48 of the outer member 26, which is also the angle that the intermesh between the groove 34' and the land 40' has turned around the centre 48 of the inner member when moving axially inwardly into the members 26, 28.

FIGS. 5C–5F then show different relative positions of the members 26, 28 as the rotation continues. As can be seen from this figures the opening area of the chamber increases continuously during the first phase of the rotation and then once more decreases down to zero in the position shown in FIG. 5F, where the angles "$\alpha$" and "$\beta$" are 90° and 450°, respectively, and the land 40'' of the inner member 28 is in full intermesh with the groove 34' of the outer member 26. In this position the chamber 66 is thus shut off from the low pressure port 52. From this position the chamber 66 is completely closed and diminishes continuously in volume up to the moment when the axially leading intermesh of the members 26, 28 reach the high pressure port and the working fluid enclosed and compressed therein is pressed out through the high pressure port 60.

Figure 6:
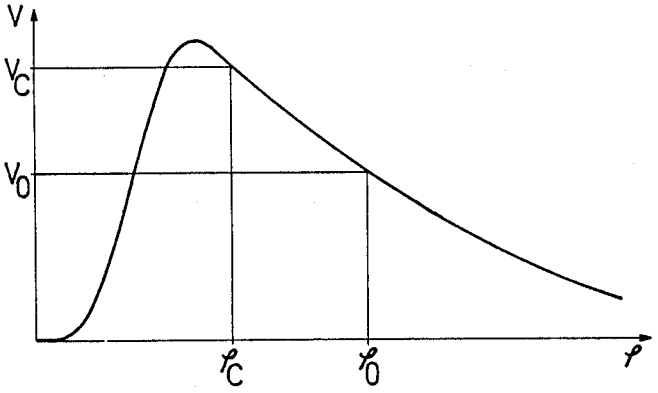
FIG. 6 shows diagrammatically the volumetric capacity of a compressor as a function of the turning angle.
Figure 5:
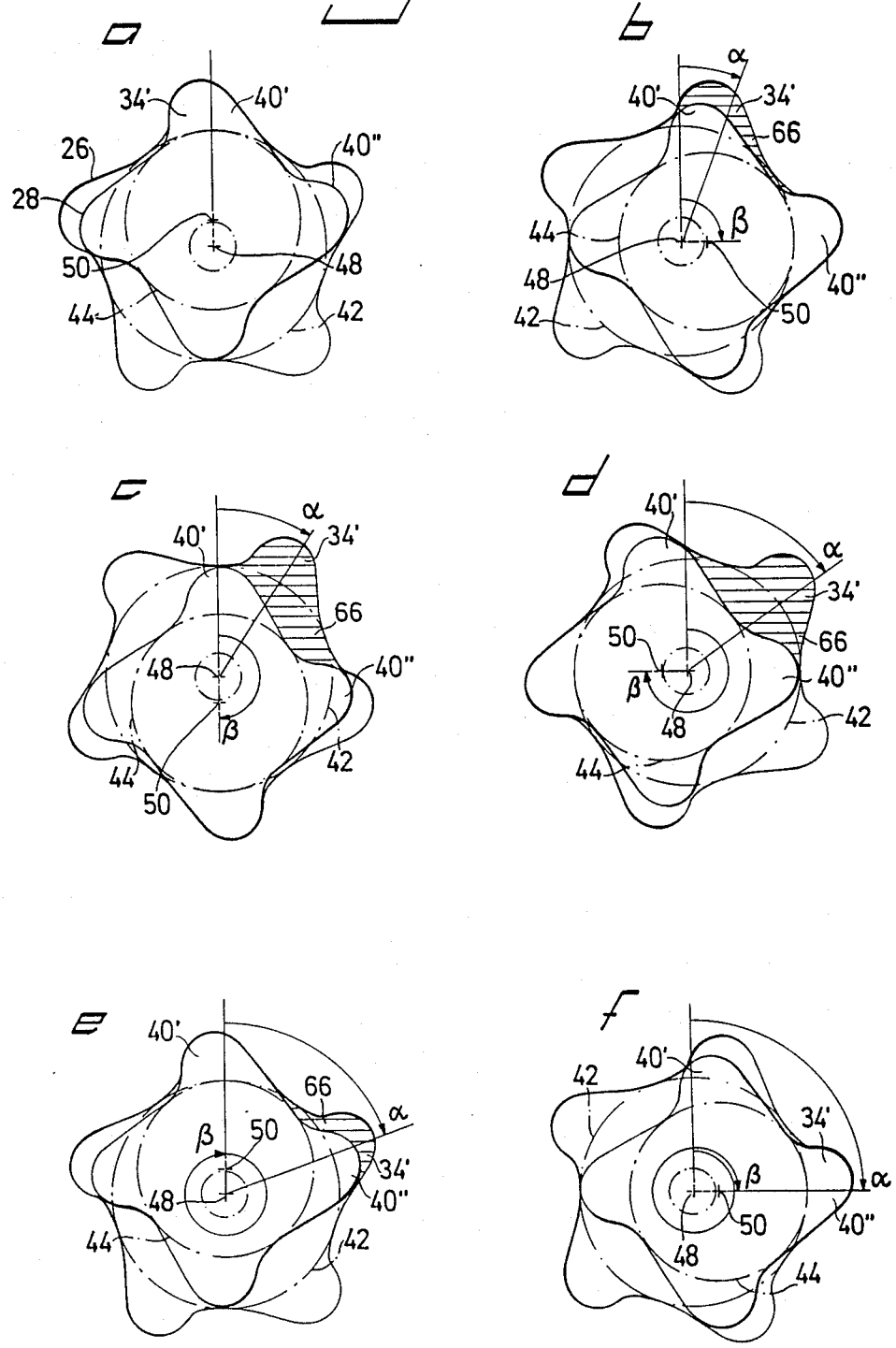
FIGS. 5A–5F show the two members in different angular positions.

In FIG. 6 the volume "V" of the chamber 66 is shown diagrammatically as a function of the angle "$\phi$" which is the turning angle, i.e. "$\beta$"-"$\alpha$", of the outer member 26 in which the axially leading intermesh of the chamber 66 is located. The angle "$\phi_c$" then indicates the angle at which the chamber 66 is closed from the low pressure port 52 whereas the angle "$\phi$" indicates where it is opened towards the high pressure port 60. As seen from the diagram the volume of the chamber 60 has a maximum ahead of the angle "$\phi_c$" at which it is closed, depending upon the fact that the members 26, 28 are tapered and the transverse section of the member grooves 34, 38 decreases in axial direction which may be best seen from FIGS. 3 and 4. Thus the increase of the volume at the axially leading intermesh limiting the chamber 66 is smaller than the decrease of the volume at the trailing intermesh thereof. The angle "$\phi_c$" is only dependent on the shape of the transverse profiles of the members 26, 28 and is always about 360° whereas the angle "$\phi_o$" is depending upon the axial length of the members 26, 28 and may be chosen such that the ratio "$V_c/V_o$" will suite the actual pressure ratio required.

In order to guarantee a good driving contact between the members 26, 28 by direct flank contact it is desirable that the contact may take place on the pitch cones where there is no sliding motion between the two contacting flanks. For this reason it is desirable that grooves 34, 38 of the outer and inner members 26, 28 intersect with the related pitch cones 42 and 44, respectively, at least at the small ends of the members 26, 28 which may be reached by designing the members 26, 28 such that the cone apex angle of each of the envelopes of said members is somewhat larger than the corresponding angle of the related pitch cone 42, 44.

In order to limit the dynamical forces it is essential to keep the distance between the centres 48, 50 of the members 26, 28 at a small value and to reduce the mass of the orbiting member 28 as much as possible. In the embodiment shown in the drawing the angle "$\epsilon$" between the axes 48, 50 of the pitch cones 42, 44 is only about 1° and the members 26, 28 are injection moulded from a light plastic material. In a refrigeration apparatus of the type shown in FIG. 1 and intended for a domestic refrigerator the dimension of the unit is such that the axial length of the compressor members 26, 28 is about 60 mm resulting in an average eccentricity between the axes 48, 50 of about 1 mm and a mass of the inner member of about 3 gram which is about 1 thousandth of the mass of the driving electric motor. The dynamical unbalanced forces will thus be so small compared with the mass of the total unit that they may be completely neglected.

In order to achieve a low pressure ratio and thus a small leakage from a chamber 66 enclosing compressed working fluid to the consecutive chamber it is preferable to increase the number of grooves 34, 38 and lands 36, 40 in the two intermeshing members 26, 28. This is also advantageous with regard to the flow conditions in the low pressure and the high pressure ports 52, 60. It is thus advantageous to provide also the inner member 28 with several grooves 38 and lands 40.

I claim:

1. Rotary positive displacement machine of hypocyclic bevel gearing type for a compressible working fluid, comprising an outer and an inner member provided with intermeshing spiral grooves and intervening lands where the number of grooves in the outer member is larger than that in the inner member with a difference therebetween of one and the wrap angle of each groove in the outer member exceeds 360°, said grooves and lands forming continuous sealing lines therebetween to define closed chambers between consecutive sealing lines, said members rolling on each other along pitch cones with coinciding apices, at least one of said members being rotatable around its axis and at least one being mounted for revolving oscillation around the apex point of the pitch cones, the circumscribing envelope of the inner member being shaped as a frustum of a cone, the outer member being shaped as a socket having an inscribing envelope in the form of a frustum of a cone and provided with open ends forming low pressure and high pressure ports for communication with stationary low pressure and high pressure channels, respectively, characterized in that the radial depth of the grooves varies axially along the members and in each transverse plane is equal to twice the eccentricity of the axes of the members and that the pitch angle of the spiral at the pitch cone varies continuously in the axial direction.

2. Machine as defined in claim 1, in which the inner member is provided with at least two grooves and intermediate lands.

3. Machine as defined in claim 2, in which the profile of the inner member in a plane perpendicular to its axis varies in the axial direction and is nonuniform in any two arbitrary planes and at least in the small end of the member shaped such that its grooves intersect with the pitch cone.

4. Machine as defined in claim 3, in which the apex of the envelope of the inner member is located inside the related pitch cone.

5. Machine as defined in any one of claims 1 or 4, in which the outer member is rotatable around its axis, whereas the inner member is non-rotatably fixed to a stationary housing but free to oscillate around the apex of its pitch cone.

6. Machine as defined in claim 5, in which the inner member in its small end is provided with a flexible extension fixedly mounted on the other side of the apex of its pitch cone.

7. Machine as defined in claim 6, in which the outer member is located inside and coaxially with the rotator shaft of an electric motor and fixed thereto for rotation therewith.

8. Machine as defined in claim 5, in which the outer member is located inside and coaxially with the rotor shaft of an electric motor and fixed thereto for rotation therewith.

9. Machine as defined in any one of claim 1 or 4, in which one member of the machine is located inside and coaxially with the rotor shaft of an electric motor and fixed thereto for rotation therewith whereas the other member is non-rotatably fixed to a stationary housing but free to oscillate around the apex of its pitch cone.

10. Machine as defined in claim 1, in which the profile of the inner member in a plane perpendicular to its axis varies in the axial direction and is non-uniform in any two arbitrary planes and at least in the small end of the member shaped such that its grooves intersect with the pitch cone.

* * * * *

UNITED STATES PATENT AND TRADEMARK OFFICE

CERTIFICATE OF CORRECTION

PATENT NO. : 4,863,357

DATED : September 5, 1989

INVENTOR(S) : Hans OLOFSSON

It is certified that error appears in the above-identified patent and that said Letters Patent is hereby corrected as shown below:

Column 5, line 28, "Ø" should read --$Ø_o$--.

Signed and Sealed this

Eighteenth Day of September, 1990

*Attest:*

HARRY F. MANBECK, JR.

*Attesting Officer*

*Commissioner of Patents and Trademarks*